US010773927B2

(12) United States Patent
Percival

(10) Patent No.: US 10,773,927 B2
(45) Date of Patent: Sep. 15, 2020

(54) ELEVATOR TRIP HAZARD LIGHT SYSTEM AND METHOD

(71) Applicant: VIP Lift & Escalator Services Limited, Essex (GB)

(72) Inventor: Ian Percival, Essex (GB)

(73) Assignee: VIP Lift & Escalator Services Limited, Essex (GB)

( * ) Notice: Subject to any disclaimer, the term of this patent is extended or adjusted under 35 U.S.C. 154(b) by 521 days.

(21) Appl. No.: 15/568,298

(22) PCT Filed: Mar. 16, 2016

(86) PCT No.: PCT/GB2016/050712

§ 371 (c)(1),
(2) Date: Oct. 20, 2017

(87) PCT Pub. No.: WO2016/170301

PCT Pub. Date: Oct. 27, 2016

(65) Prior Publication Data

US 2018/0148299 A1 May 31, 2018
US 2018/0334364 A9 Nov. 22, 2018

(30) Foreign Application Priority Data

Apr. 20, 2015 (GB) ..... 1506645.9
Jun. 22, 2015 (GB) ..... 1510912.7

(51) Int. Cl.
*B66B 3/02* (2006.01)
*B66B 13/28* (2006.01)
(Continued)

(52) U.S. Cl.
CPC ..... *B66B 13/28* (2013.01); *B66B 3/002* (2013.01); *B66B 13/285* (2013.01); *B66B 19/007* (2013.01)

(58) Field of Classification Search
USPC ..... 187/390
See application file for complete search history.

(56) References Cited

U.S. PATENT DOCUMENTS 5,609,224 A * 3/1997 Baggot ..... B66B 13/301 187/313
7,677,364 B2 * 3/2010 Begle ..... B66B 13/301 187/391

(Continued)

FOREIGN PATENT DOCUMENTS

EP 2746208 A1 6/2014
JP S60 137773 U 9/1985

(Continued)

OTHER PUBLICATIONS

European International Search Report and Written Opinion of the International Searching Authority, dated Jul. 4, 2016, for PCT/GB2016/050712.

(Continued)

*Primary Examiner* — Christopher Uhlir
(74) *Attorney, Agent, or Firm* — Quarles & Brady LLP; James J. Aquilina

(57) ABSTRACT

The present application relates to an elevator system and a method of adapting an elevator system, the system being adapted to warn elevator users of the existence of a vertical misalignment between a floor of a lift car and a landing surface adjacent to which the lift car stops. The elevator system comprises facing parallel walls that depend vertically downwards from a leading edge of the lift car floor and a leading edge of the landing surface respectively. A luminaire is mounted on at least one of said walls at a distance below the edge of said wall so as to face the opposing wall irrespective of said vertical misalignment. Light from said luminaire illuminates said opposing walls to alert elevator users to the existence of said vertical misalignment.

20 Claims, 13 Drawing Sheets

(51) Int. Cl.
*B66B 3/00* (2006.01)
*B66B 19/00* (2006.01)

(56) References Cited

U.S. PATENT DOCUMENTS

2002/0125077 A1* 9/2002 Shikai ..... B66B 13/26
187/317
2013/0327599 A1* 12/2013 Somma ..... B66B 11/0253
187/401
2016/0185571 A1* 6/2016 Curzon ..... B66B 5/02
187/313

FOREIGN PATENT DOCUMENTS

JP H07 228459 A 8/1995
JP 2003 146567 A 5/2003
JP 2007 168951 A 7/2007
JP 2012 071971 A 4/2012

OTHER PUBLICATIONS

Communication pursuant to Article 94(3) EPC from corresponding European Application No. 16 713 007.9, dated Jul. 17, 2020 (7 pages).

* cited by examiner

ELEVATOR TRIP HAZARD LIGHT SYSTEM AND METHOD

The present invention relates to a method of adapting an elevator system and to an elevator system that has been adapted according to the invention.

Lift cars used in elevator systems to convey passengers between floors of a building are designed to stop to within ±2 millimetres of a destination floor landing. This is to limit the size of the step that exists between the lift car floor and the landing. However, precise stopping of a lift car is not always achieved and this can present a trip hazard for passengers entering and exiting the lift car.

It is known to illuminate the gap between the landing and the lift car by directing light at the gap from above. However, such methods of illumination do not adequately highlight the step between the lift car floor and the landing, and therefore do not properly indicate the presence of a trip hazard.

It is an object of the invention to provide an elevator system and a method of adapting an elevator system to specifically indicate the existence of a trip hazard between the lift car floor and the landing.

According to the present invention, there is provided a method of adapting an elevator system to warn elevator users of the existence of a vertical misalignment between a floor of a lift car and a landing surface adjacent to which said lift car stops, and where there is a gap between facing parallel walls depending vertically downwards from a leading edge of the lift car floor and a leading edge of the landing surface, respectively, the method including positioning a luminaire on at least one of said walls so that the luminaire directs light toward the opposing wall irrespective of said vertical misalignment, and so that at least a portion of the light from said luminaire reflects off said opposing wall prior to passing out of said gap.

Where the elevator system has a maximum accepted level of misalignment at which the elevator system will remain operational, the method may comprise positioning the luminaire at a distance below said edge by a distance which is greater than said maximum accepted level of misalignment.

The method may further comprise making the or each wall reflective.

The method may further comprise applying a reflective material or coating to the or each wall.

The method may further comprise applying a reflective sheet to the or each wall.

Where the wall depending from the leading edge of the lift car floor is a toe guard, the method may include the step of positioning a luminaire on said toe guard.

Where the toe guard comprises an opening, the method may include the step of positioning a luminaire in the opening so that it is flush with, or recessed below, a front surface of the toe guard.

Where the toe guard comprises a plurality of openings provided across the width of the toe guard, the method may include the step of mounting a luminaire in each of the plurality of openings to provide illumination across the width of the toe guard.

Where the luminaire is an LED strip light, the method may include the step of mounting the LED strip light to the or each wall.

Where the toe guard comprises a mounting surface extending from a front face of the toe guard, the method may include the step of mounting a luminaire onto the mounting surface to direct light across the front face of the toe guard.

Where said mounting surface is perpendicular to a front face of the toe guard, the method may include the step of mounting a luminaire onto the mounting surface to direct light across the front face of the toe guard.

The method may comprise the additional steps of applying a translucent filter to the luminaire and directing light from said luminaire through the translucent filter to flood said gap with diffuse light.

Where the wall depending from the leading edge of the lift car floor is a translucent toe guard, the method may include the step of positioning the luminaire to direct light into the toe guard such that the toe guard diffuses the light emitted by the luminaire to flood said gap with diffuse light.

According to the present invention there is also provided an elevator system comprising a lift car, the system being adapted to warn elevator users of the existence of a vertical misalignment between a floor of the lift car and a landing surface adjacent to which the lift car stops, and where there is a gap between facing parallel walls depending vertically downwards from a leading edge of the lift car floor and a leading edge of the landing surface, respectively, the system including a luminaire on at least one of said walls, wherein the luminaire is configured to direct light toward the opposing wall irrespective of said vertical misalignment so that at least a portion of the light from said luminaire reflects off said opposing wall prior to passing out of said gap.

There may be a maximum accepted level of misalignment between the lift car floor and the landing at which the elevator system will remain operational, the luminaire being positioned at a distance below said edge by a distance which is greater than said maximum accepted level of misalignment. The maximum accepted level of misalignment may be a level at which, if exceeded, the elevator will no longer function and may become disabled.

One or both walls may be reflective.

A reflective material or coating may be applied to one or both walls.

A reflective sheet may be applied to one or both walls.

The wall depending from the leading edge of the lift car floor may be a toe guard.

The toe guard may comprise an opening, the luminaire being received in the opening so that a light emitting portion of the luminaire is flush with, or recessed below, a front face of the toe guard.

The toe guard may comprise a plurality of openings extending across the width of the toe guard, wherein a luminaire is received in each of the openings to provide illumination across the width of the toe guard.

The luminaire may be an LED strip light.

The toe guard may comprise a mounting surface extending from a front face of the toe guard, and wherein the luminaire is mounted on the mounting surface to direct light across the front face of the toe guard.

The mounting surface may be perpendicular to the front face of the toe guard so that the luminaire directs light transversely across its front face.

The luminaire may comprise a translucent filter configured to diffuse light emitted by the luminaire to flood said gap with diffuse light.

The wall depending from the leading edge of the lift car floor may be a translucent toe guard, wherein the luminaire is configured to direct light into said toe guard such that said toe guard diffuses the light emitted by the luminaire to flood said gap with diffuse light.

So that the present invention may be more fully understood embodiments thereof will now be described with reference to the accompanying drawings in which.

Figure 1:
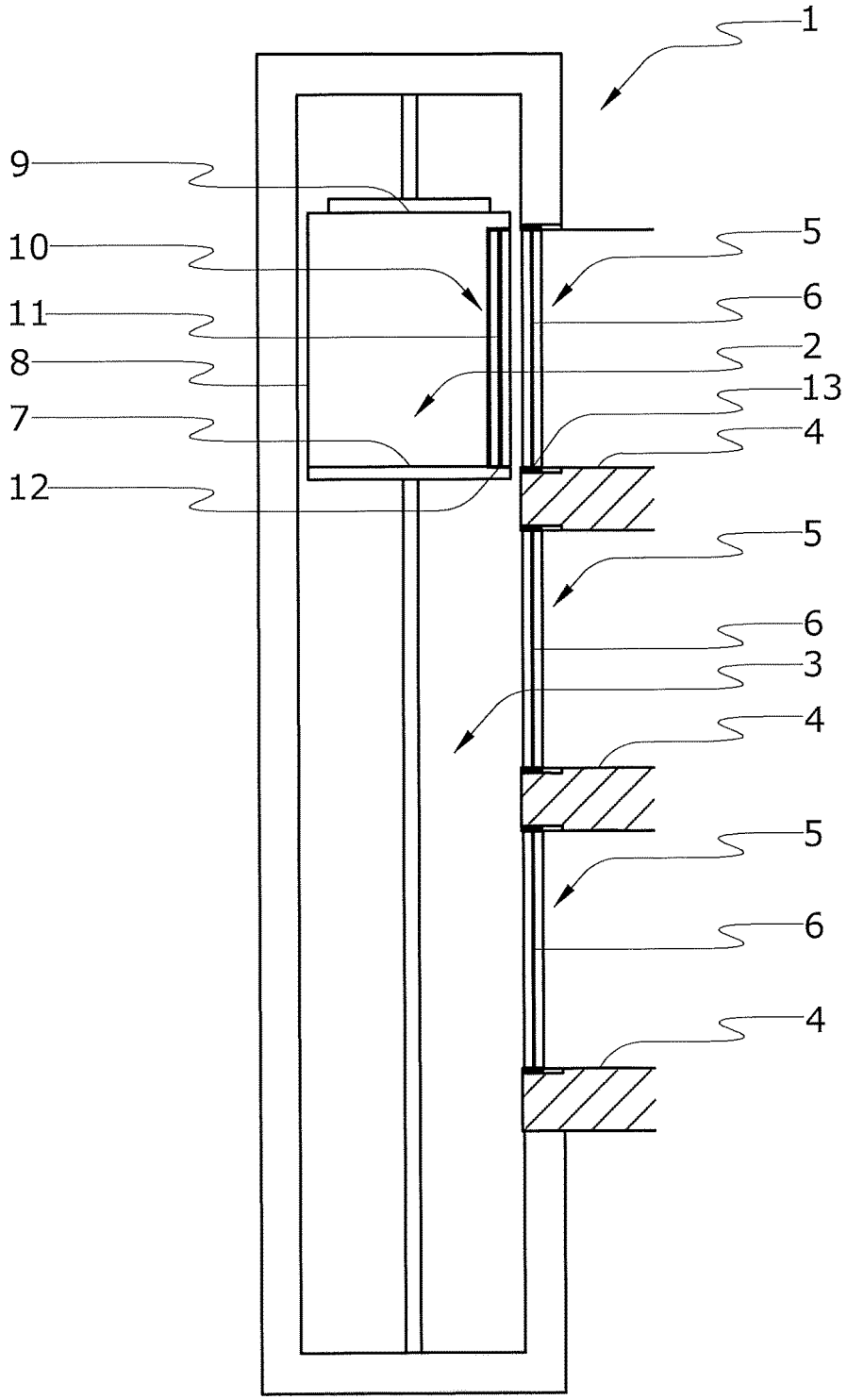
FIG. 1 is a section view of a lift shaft having a lift car.

A conventional elevator system 1 as shown in FIG. 1 is described herein for reference. The elevator system comprises a lift car 2 suspended in a vertical lift shaft 3 and moveable along the lift shaft 3 to convey passengers in the lift car 2 between any number of building floor levels. The building floor level immediately around the lift shaft is referred to as the landing 4. Landing doorways 5 are formed in the lift shaft 3 to communicate with each landing 4. Landing doors 6 are provided to selectively block the landing doorway 5 and are slideably arranged with respect to the landing doorway 5 so that they may take a closed position to block the landing doorway 5, when the lift car 2 is not aligned with the landing doorway 5, and an open position, when the lift car 2 is aligned with the landing doorway 5, so that waiting passengers standing on the landing 4 can enter and exit the lift car 2. With the landing door 6 in the closed position, waiting passengers standing on the landing 4 are protected from exposure to the open lift shaft 3.

The lift car 2 comprises a floor 7 and a plurality of vertical walls 8 arranged around the floor 7 to enclose the floor 7 and to define a safe area in which passengers stand when aboard the lift car 2. The lift car 2 yet further comprises a roof 9 which connects the top edges of the vertical walls 8 and protects the passengers from exposure to any moving parts used to move the lift car 2 along the lift shaft 3. A lift car doorway 10 is provided in at least one of the vertical walls 8 and is disposed so as to align with the landing doorway 5 when the lift car 2 is stationary at the respective landing 4. Lifts car doors 11 are slideably arranged with respect to the lift car doorway 10 to selectively block the doorway 10. When the lift car doorway 10 is aligned with a landing doorway 5, the lift car door 11 and the landing door 6 simultaneously slide into an open position to allow passengers to enter and exit the lift car 2. The lower edges of the landing and lift car doorways 5/10 are respectively referred to as the landing sill 13 and lift car sill 12.

In operation of the elevator system 1, the lift car 2 is moved along the lift shaft 3 until the lift car doorway 10 and the landing doorway 5 of a required floor are aligned. The lift car door 11 and the landing door 6 simultaneously slide into an open position to allow passengers to enter and exit the lift car 2. A motion sensor or similar detecting system determines that the movement of passengers is complete and the lift car door 11 and the landing door 6 slide into a closed position. The lift car 2 is then moved along the vertical shaft 3 to convey the passengers to another floor whereupon the doorways align and the respective doors slide into an open position to allow the passengers to disembark onto the landing 4 and any waiting passengers to enter the lift car 2.

Figure 2:
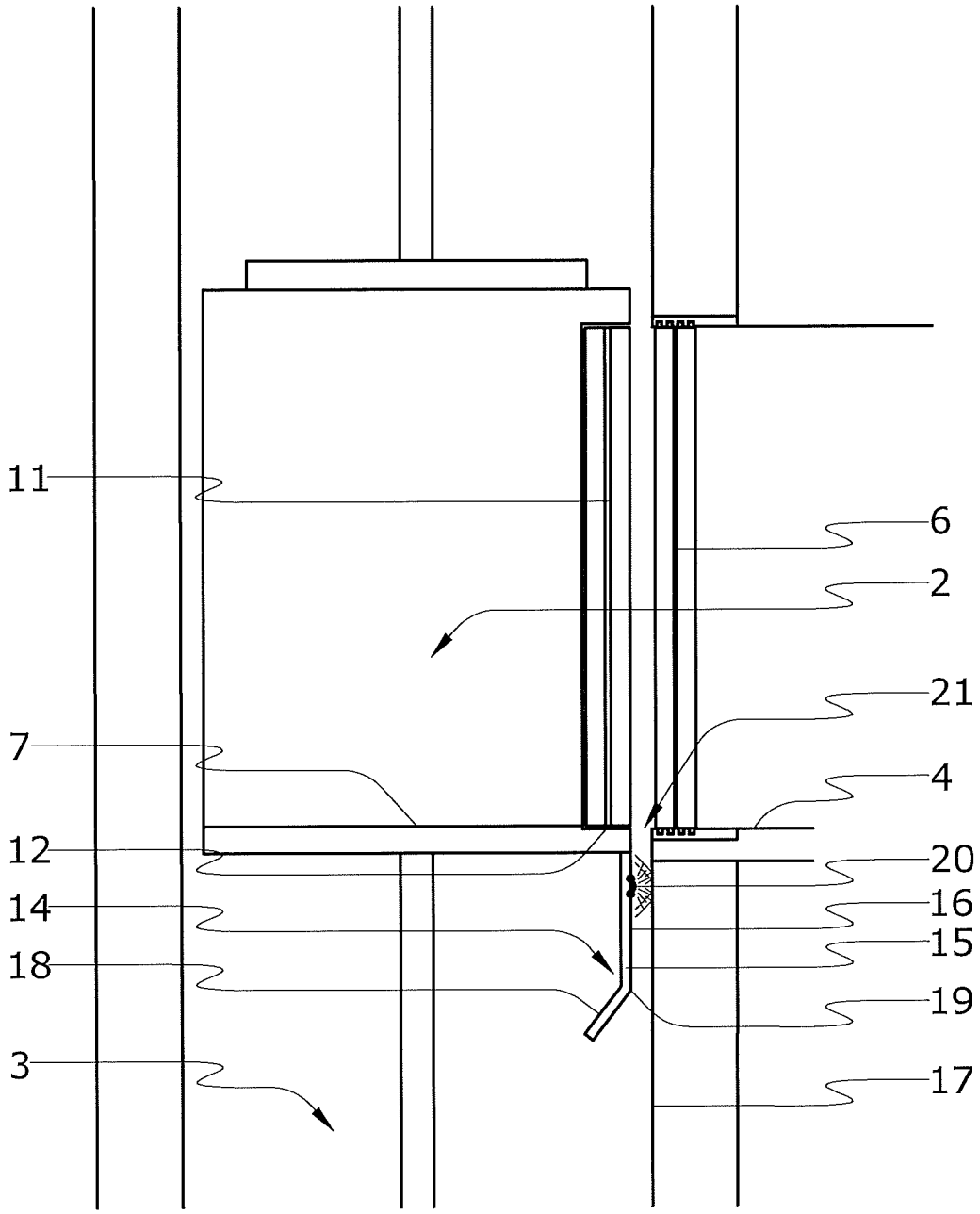
FIG. 2 is a partial section view of a lift shaft having a lift car according to the present invention.

An elevator system 1 according to the present invention is shown in FIG. 2, wherein the lift car 2 further comprises a toe guard 14. The toe guard 14 comprises a flat plate 15 mounted below the lift car doorway sill 12 to extend vertically below the lift car floor 7 so that a planar face 16 of the flat plate 15 is proximate to a vertical wall 17 of the lift shaft 3. The toe guard 14 further comprises a bent section 18 that extends out of alignment from the flat plate 15 along a lower edge 19 of the flat plate 15, the bent section 18 extending away from the vertical wall 17 of the lift shaft 3. The toe guard 14 extends along the full width of the lift car 2. In the event the lift car 2 stops above the level of the landing 4 and the landing doors 6 are opened, the toe guard 14 protects waiting passengers standing on the landing 4 from exposure to the lift shaft 3 through the space between the landing 4 and the lift car floor 7.

The lift car 2 of FIG. 2 is shown stopped with the lift car floor 7 and landing 4 aligned and coplanar and with both the lift car doors 11 and landing doors 6 in an open position so that passengers may easily enter and exit the lift car 2. With the lift car floor 7 and landing 4 aligned as shown, passengers may enter and exit the lift car 2 without any risk of tripping over the sill of the lift car 12 or the sill of the landing 13. According to the present invention, the toe guard 14 further comprises a luminaire 20 mounted to the flat plate 15 to illuminate the vertical wall 17 of the lift shaft 3. Light from the luminaire 20 reflects off the vertical wall 17 of the lift shaft 3 to illuminate the gap between the respective landing and lift car sills 13/12. The gap between the respective landing and lift car sills 13/12 is herein referred to as the running clearance 21.

Figure 3:
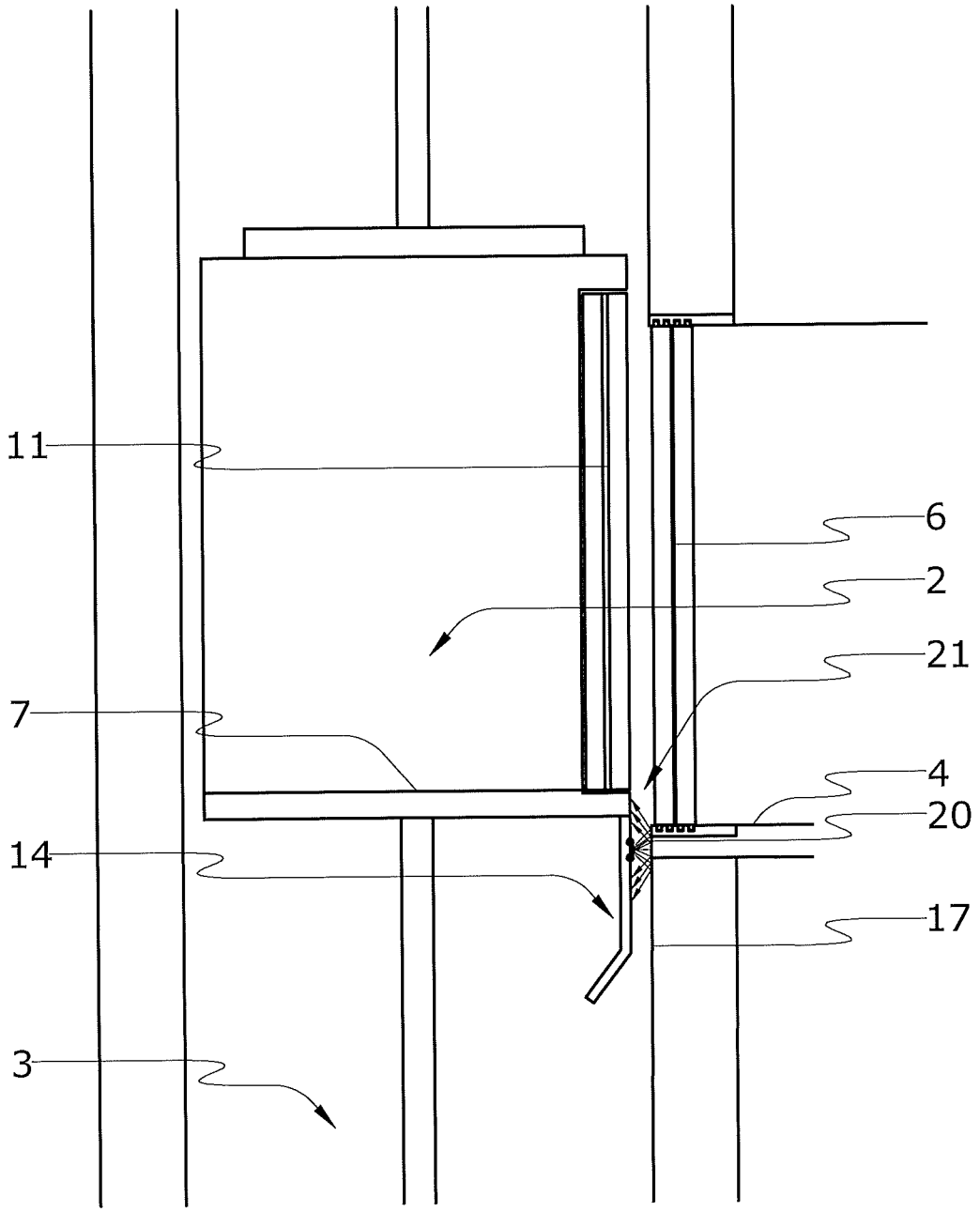
FIG. 3 is a partial section view of the lift shaft of FIG. 2, wherein the lift car is in a first position.

Referring to FIG. 3, the lift car 2 of FIG. 2 is shown stopped with the lift car floor 7 and landing 4 misaligned so that the lift car floor 7 is disposed a distance above the landing 4 sufficient to present a trip hazard to passengers entering the lift car 2. The elevator system determines that the lift car 2 has stopped and so opens both the lift car and landing doors 11/6 so that passengers may enter and exit the lift car 2. Light from the luminaire 20 reflects from the vertical wall 17 of the lift shaft 3 to impinge upon the toe guard 14, therefore illuminating the toe guard 14 to passengers entering the lift car 2 and warning them of the trip hazard presented by the lift car sill 12 as a result of the misalignment of the lift car floor 7 and landing 4.

Figure 4:
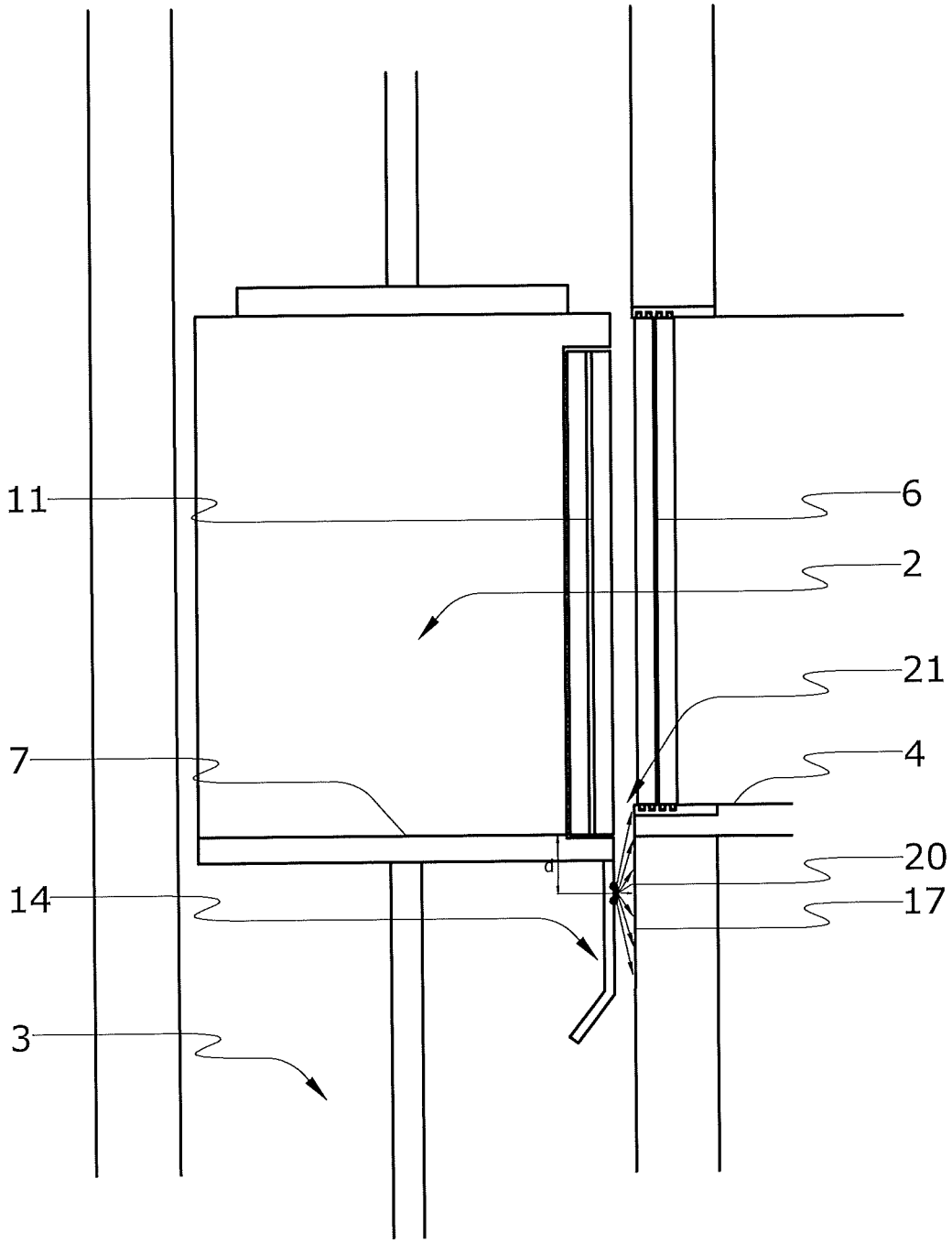
FIG. 4 is a partial section view of the lift shaft of FIG. 2, wherein the lift car is in a second position.

Referring to FIG. 4, the lift car 2 of FIG. 2 is shown stopped with the lift car floor 7 and landing 4 misaligned so that the lift car floor 7 is disposed a distance below the landing 4 sufficient to present a trip hazard to passengers exiting the lift car 2. The elevator system determines that the lift car 2 has stopped and so opens both the lift car and landing doors 11/6 so that passengers may enter and exit the lift car 2. Light from the luminaire 20 reflects from the vertical wall 17 of the lift shaft 3 to illuminate the vertical wall 17 of the lift shaft 3 to passengers exiting the lift car 2 and warning them of the trip hazard created by the misalignment of the lift car floor 7 and landing 4.

The luminaire 20 is mounted to the planar face 16 of the toe guard 14 a distance (d) below the lift car floor 7.

According to the invention, the distance (d) is selected such that the luminaire 20 remains below the level of the lift car floor 7 and the landing 4 when the lift car and landing doors 11/6 are open so that passengers are not in line of sight of the luminaire 20; therefore passengers looking directly at the running clearance 21 are not dazzled.

According to the invention the elevator system may be configured to prevent the lift car doors 11 and or the landing doors 6 from opening if the lift car floor 7 and the landing 4 exceed a maximum accepted level of misalignment. In such embodiments, the distance (d) is selected to be greater than the maximum accepted level of misalignment such that the luminaire 20 remains below the level of the lift car floor 7 and the landing 4 when the lift car and landing doors 11/6 are open.

In one embodiment of the invention, the maximum accepted level of misalignment is between 50 and 300 millimetres. In a preferred embodiment, the maximum accepted level of misalignment is 100 millimetres. The maximum accepted level of misalignment may be a level at which the lift will become disabled if any further misalignment occurs or at which an alarm will sound to warn a lift operator that a maximum acceptable level of misalignment has been exceeded and maintenance to the lift is required.

It shall be appreciated that the distance (d) below the lift car floor 7 that the luminaire 20 is mounted will determine the intensity of light visible to passengers. Moving the mounting point of the luminaire 20 in a direction further below the lift car floor 7 will reduce the intensity of light reflected toward a passenger.

According to the invention, the luminaire 20 may be permanently illuminated when the elevator system is in operation. Alternatively, the luminaire 20 may be configured to be illuminated only when required so as to save energy. In one embodiment, the luminaire is configured to be illuminated only when the lift car doors 11 are open on receipt of an electrical signal from the lift car door opening apparatus. In another embodiment, the luminaire 20 is configured to be illuminated by a motion sensor so that the luminaire 20 is switched on as a passenger approaches the running clearance 21. In yet another embodiment, the luminaire 20 is configured to be illuminated at the same time as the lift car lighting. In certain embodiments, the luminaire 20 may only illuminate if a misalignment, or a certain level of misalignment, is detected. It will also be appreciated that the luminaire may not be illuminated continuously but may flash or strobe to enhance the visibility of the misalignment to a user.

The luminaire may take a number of forms and be mounted in a number of ways as described in more detail below.

Figure 5:
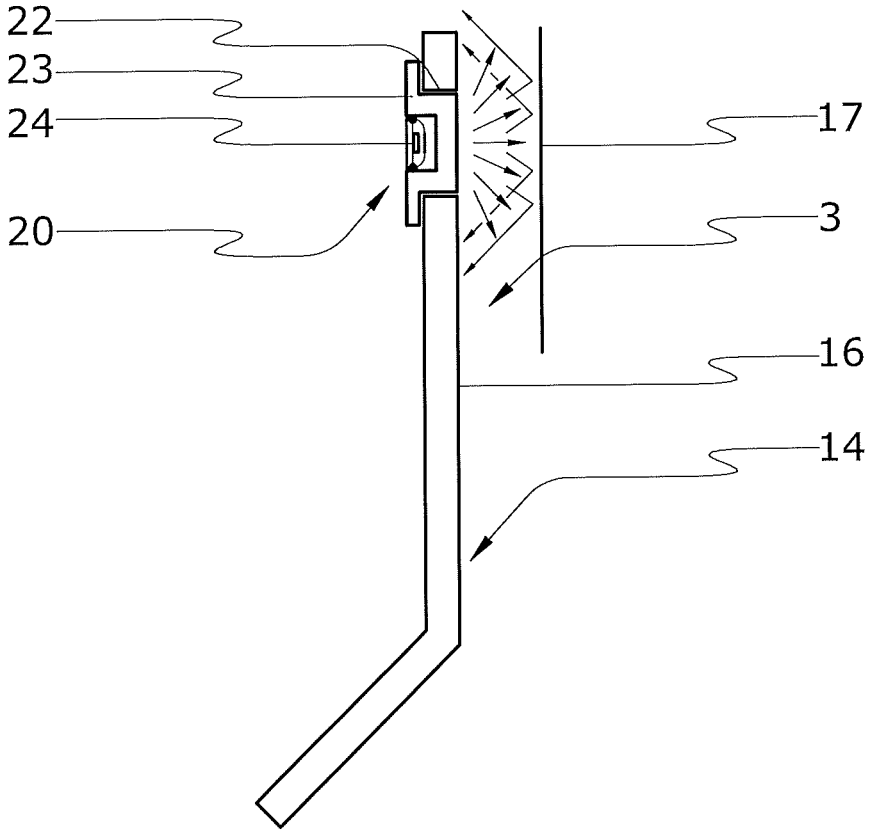
FIG. 5 is a partial detail view of a toe guard according to an embodiment of the present invention.

A toe guard 14 according to an embodiment of the present invention is shown in FIG. 5, an opening 22 is formed in the toe guard 14 into which a luminaire 20 is mounted. This provides the advantage that the luminaire 20 can be recessed in the toe guard 14 so that a portion of the luminaire body 23 is located behind the toe guard 14, distal to 3*o* the vertical wall 17 of the lift shaft 3. This enables a light emitting portion 24 of the luminaire 20 to be flush with or recessed from a face 16 of the toe guard 14 proximate to the vertical wall 17 of the lift shaft 3. Therefore, a larger luminaire 20 can be used in elevator systems where the clearance between the face of the toe guard 16 and the vertical wall 17 of the lift shaft 3 would be limiting. Furthermore, with the luminaire 20 mounted so that the light emitting portion 24 of the luminaire 20 is flush with or recessed from the face 16 of the toe guard 14, the light emitting portion 24 of the luminaire 20 is spaced further from the vertical wall 17 of the lift shaft 3 than if mounted proud of the face 16 of the toe guard 14. It shall be appreciated that this increases the spread of light incident on the vertical wall 17 of the lift shaft 3 and therefore increases the proportion of light, and thus the intensity of light, reflected toward a passenger. Likewise moving the light emitting portion 24 of the luminaire 20 closer to the vertical wall 17 of the lift shaft 3 reduces the proportion of light, and thus the intensity of light, reflected toward a passenger.

It shall be appreciated that any number of openings 22 may be provided in the toe guard 14 for any number of luminaires 20 to be mounted therein. Likewise, the distribution and positioning of the openings 22 may be selected as required, for example, in one unillustrated embodiment, a plurality of luminaires 20 are provided and are mounted in respective openings 22 arranged in a row extending transversely across the width of the toe guard 14.

Figure 6:
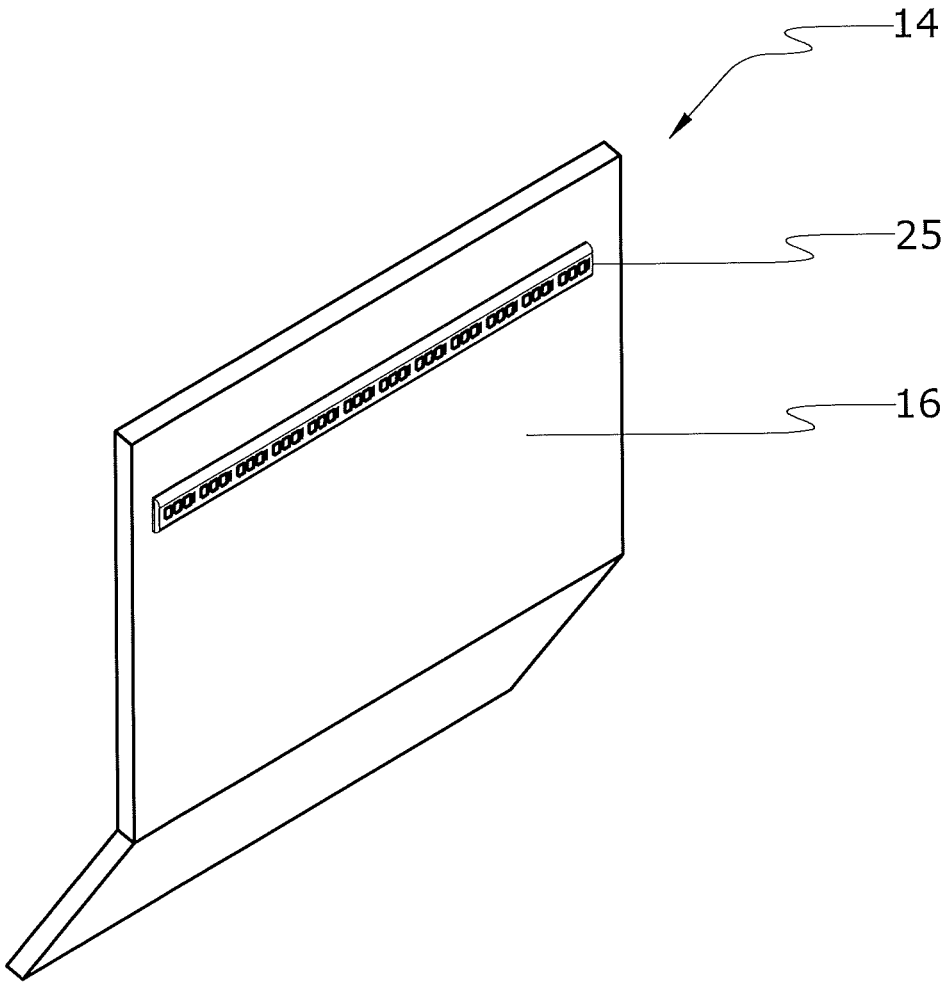
FIG. 6 is a partial detail view of a toe guard according to another embodiment of the present invention.

A toe guard 14 according to another embodiment of the invention is shown in FIG. 6, linear luminaires 25 such as strip LED lighting can be mounted to the face 16 of the toe guard 14. Therefore, no further modification of the toe guard 14 is required reducing the complexity of the device and the installation time.

Figure 7A:
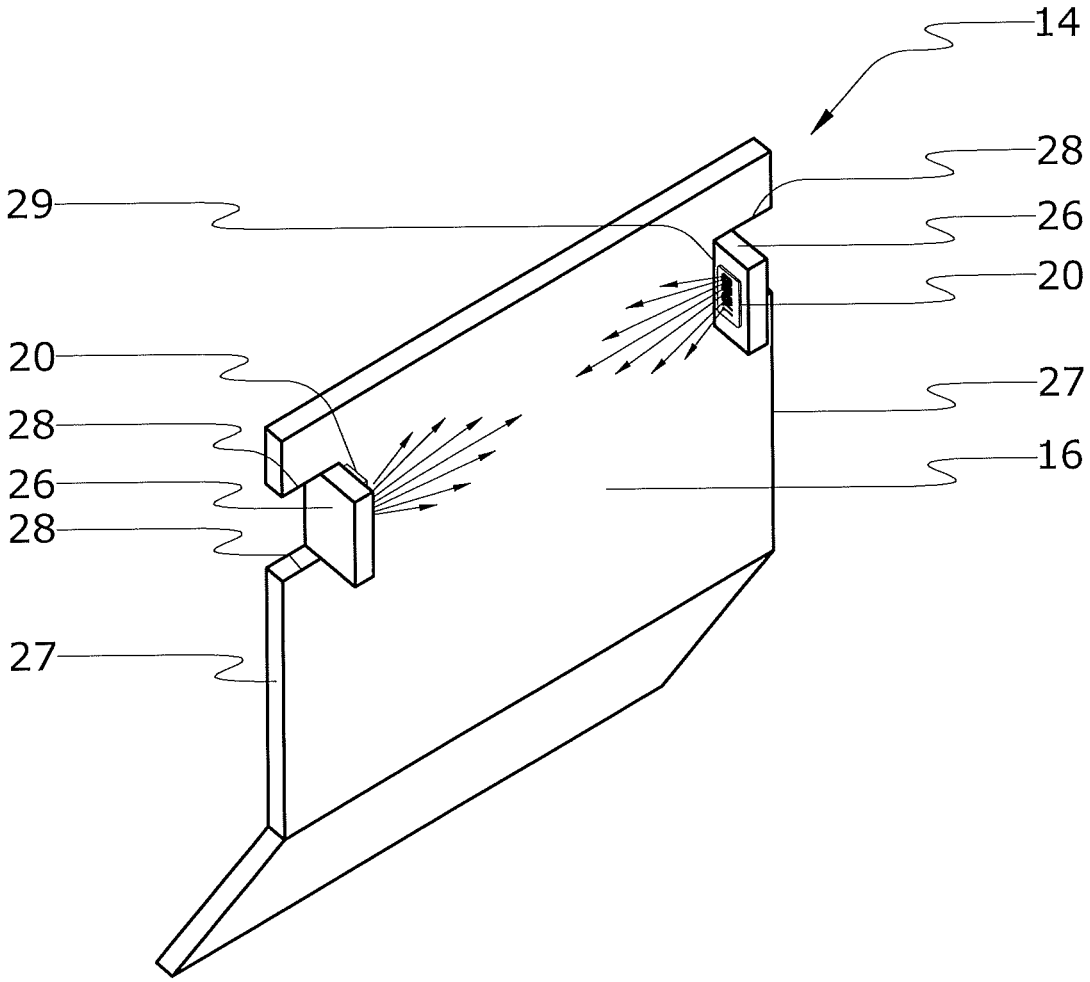
FIG. 7A is a partial detail view of a toe guard according to another embodiment of the present invention.
Figure 7B:
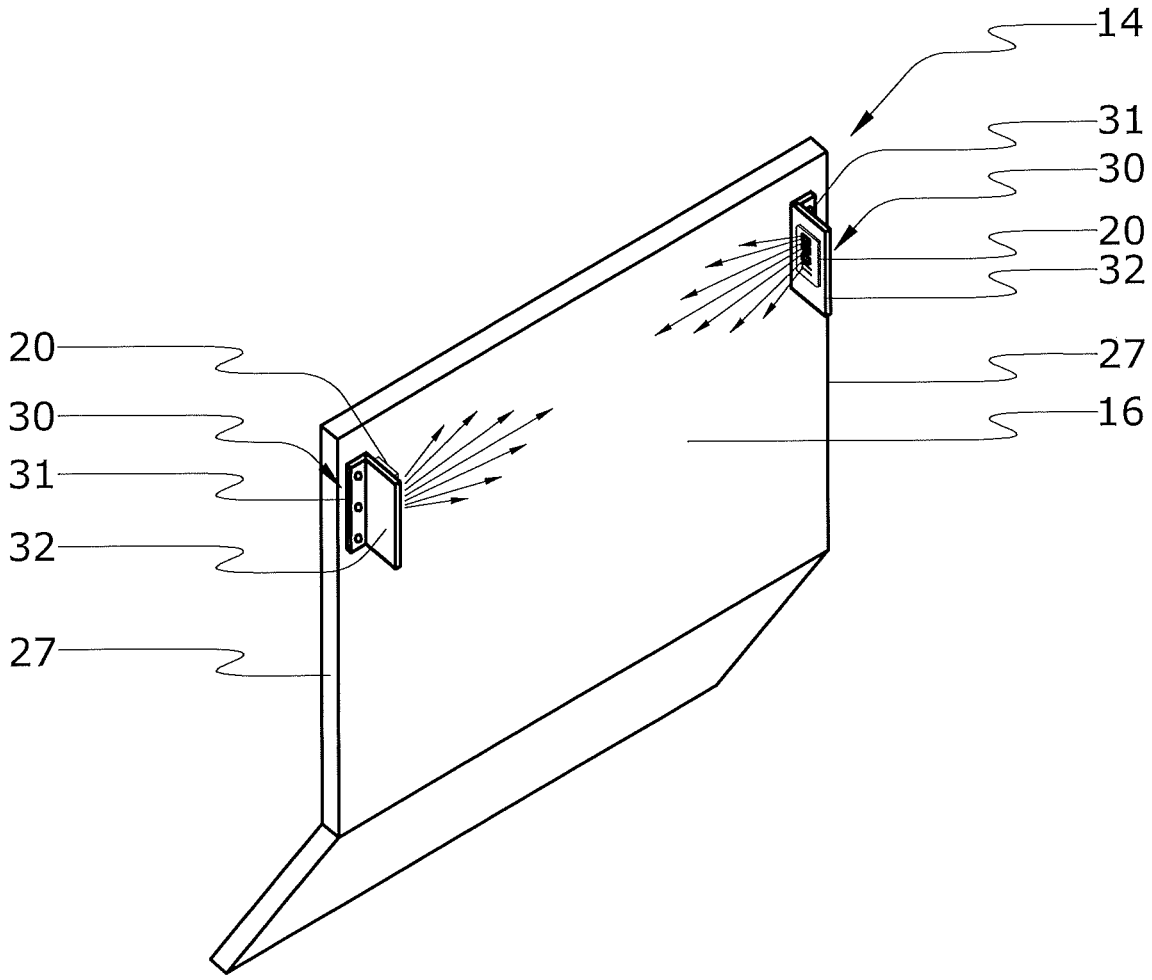
FIG. 7B is a partial detail view of a toe guard according to another embodiment of the present invention.

A toe guard 14 according to yet another embodiment of the invention shown in FIGS. 7A and 7B, the toe guard 14 is modified further to provide mounting surfaces 26 perpendicular to the face 16 of the toe guard 14. In one example of this embodiment, specifically illustrated in FIG. 7A, the mounting surfaces 26 are formed from a portion of the toe guard adjacent vertical edges 27 of the toe guard 14. Said portion of the toe guard 14 is delineated by pairs of cut lines 28 extending perpendicular from each vertical edge 27 and a bend line 29 extending between distal ends of each pair of cut lines 28. To form the mounting surfaces 26, each of said portions is bent away from the toe guard 14 along said bend lines 29 to extend perpendicular to the face 16 of the toe guard 14. Luminaires 20 are mounted to the mounting surfaces 26 so that light shines transversely across the face 16 of the toe guard 14 toward an opposing vertical edge 27. In another example of this embodiment shown in FIG. 7B, L shaped brackets 30 are mounted to the face 16 of the toe guard 14. Each L shaped bracket 30 has a base plate 31 which is attached to the toe guard 14 by any suitable means and a mounting plate 32 upstanding perpendicularly from one edge of the base plate 31 to which a luminaire 20 is mounted. The bracket 30 is oriented such that light from the luminaire 20 shines transversely across the face 16 of the toe guard 14 toward one of said vertical edges 27 of the toe guard 14. However, it shall be appreciated that the bracket 30 may alternatively be mounted so that the luminaire 20 is oriented in any desired direction. By shining light across the face 16 of the toe guard 14 toward a distal vertical edge 27, the intensity of light directed toward the vertical wall 17 of the lift shaft is reduced, therefore reducing the intensity of light reflected toward a passenger.

Figure 8A:
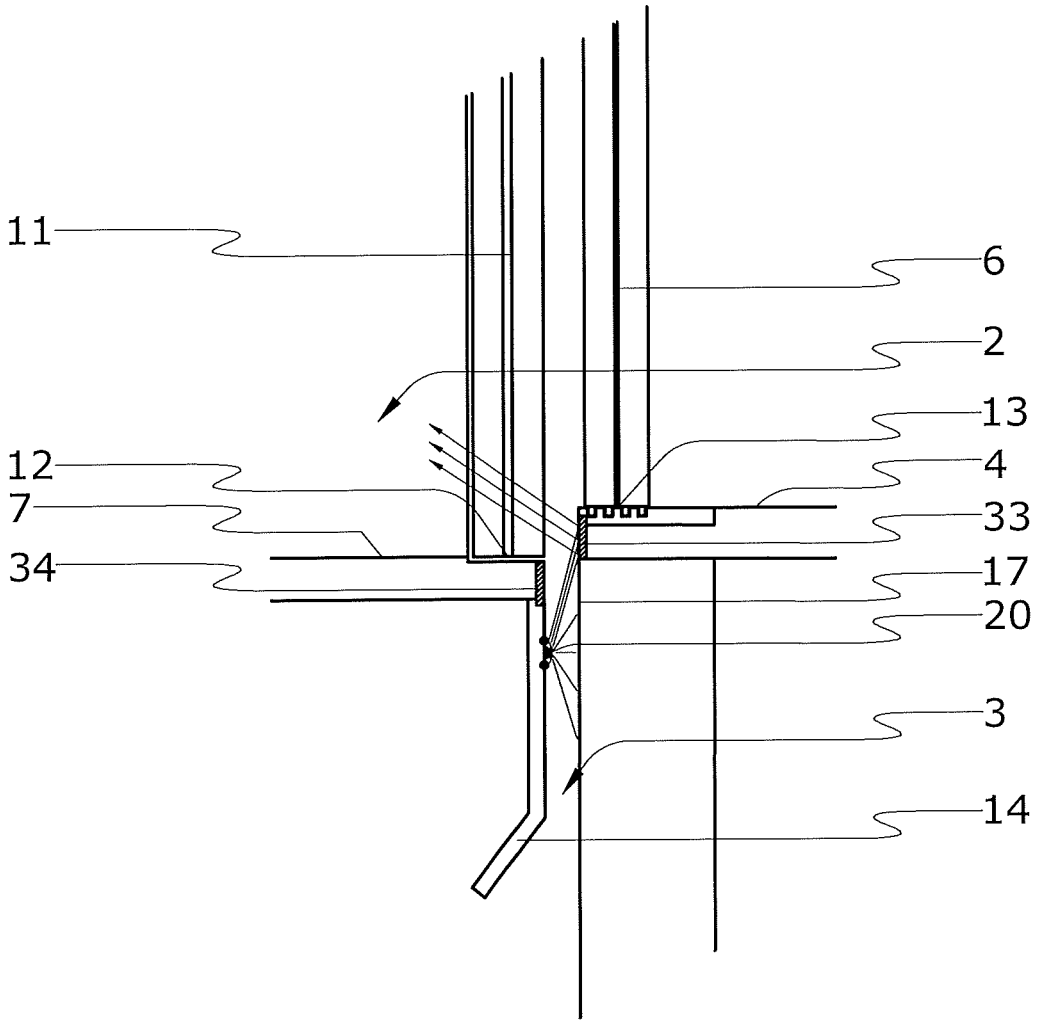
FIG. 8A is a partial section view of a lift shaft having a lift car according to another embodiment of the present invention.

The elevator system may additionally comprise first and second reflectors 33/34 as shown in FIG. 8A, wherein the first reflector 33 is mounted to the vertical wall 17 of the lift shaft 3 proximate to the landing sill 13 and extending along the full width of the sill 13, and the second reflector 34 is mounted along an upper end of the toe guard 14 proximate to the lift car door sill 12. The lift car 2 of FIG. 8A is shown stopped with the lift car floor 7 and the landing 4 misaligned so that the lift car floor 7 is disposed below the landing 4. With the lift car and landing doors 11/6 in the open position, passengers standing in the lift car are in direct line of sight of the first reflector 33. A portion of light emitted by the luminaire 20 is incident on the first reflector 33 and is reflected toward the passengers standing in the lift car 2.

Figure 8B:
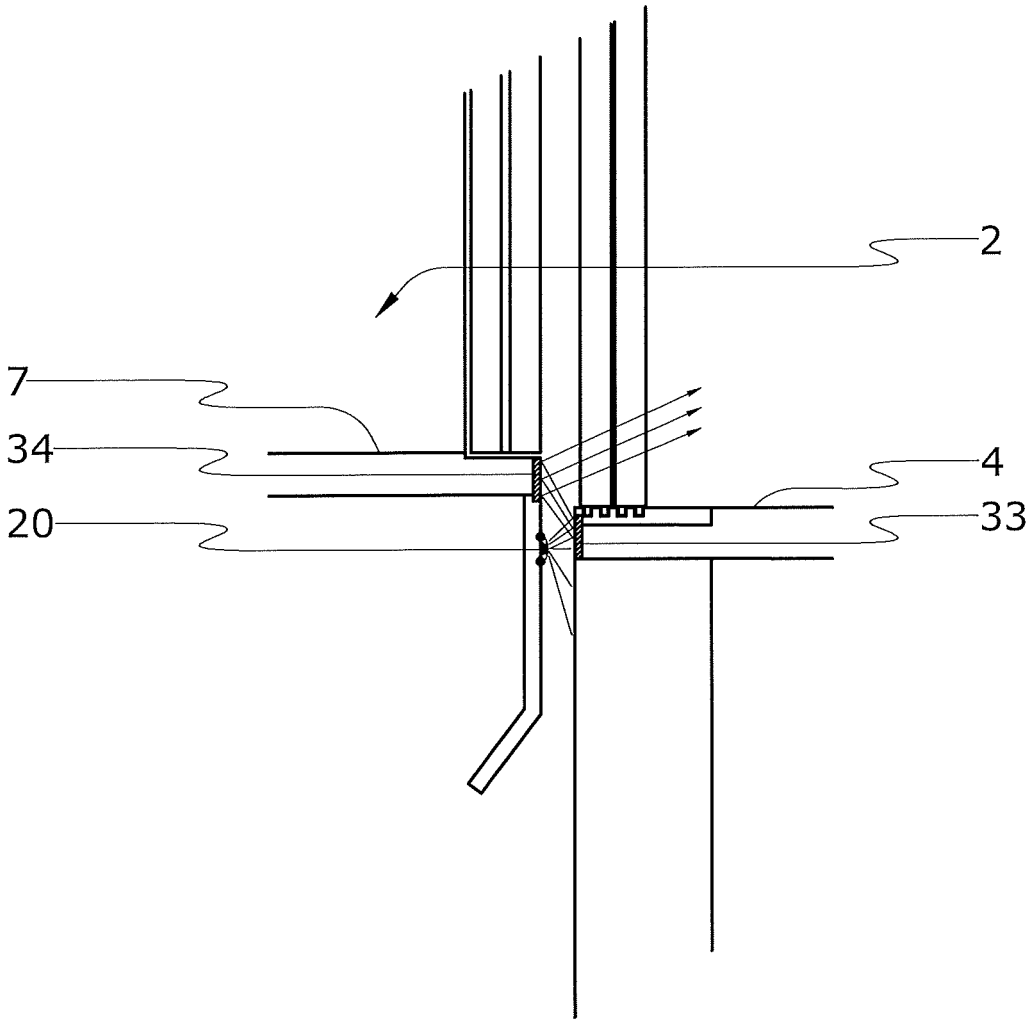
FIG. 8B is a partial section view of the lift shaft of FIG. 8A, wherein the lift car is in a second position.

Referring now to FIG. 8B, the lift car 2 of FIG. 8A is shown stopped with the lift car floor 7 and the landing 4 misaligned so that the lift car floor 7 is disposed above the landing 4. With the lift car and landing doors 11/6 in the open position, passengers standing on the landing 4 are in direct line of sight of the second reflector 34. A portion of light emitted by the luminaire 20 is reflected by the first reflector 33 so that a portion of reflected light is incident on the second reflector 34 whereupon it is reflected toward the passengers standing in the lift car 2. The gap or running clearance 21 acts as a light guide to guide the light in an upward direction along the gap as it is reflected off the opposing walls and until it emerges from the gap and is visible to passengers. The reflectors may act to diffuse the light to reduce its intensity and/or glare.

In FIGS. 8A and 8B, the respective reflectors are configured to increase the intensity of light reflected toward passengers and therefore increase the visibility of a trip hazard. Although in the above embodiments luminaires 20 are mounted to the toe guard 14, it shall be appreciated that luminaires 20 may alternatively be mounted to the vertical wall 17 of the lift shaft 3, wherein a luminaire 20 is disposed proximate to each landing 4. When the lift car doorway 10 is aligned to a respective landing doorway 5, light from the luminaire 20 floods the gap between the vertical wall 17 of the lift shaft 3 and the toe guard 14 to illuminate the running clearance 21 in the manner described above. In such embodiments, the luminaire 20 is mounted a distance below the respective landing so that the luminaire 20 remains below the level of the lift car floor 7 and the landing 4 when the lift car and landing doors 11/6 are open so that passengers are not in line of sight of the luminaire 20.

In embodiments wherein the elevator system is configured to prevent the lift car doors n and or the landing doors 6 from opening if the lift car floor 7 and the landing 4 are not aligned within a maximum accepted level of misalignment, the luminaire 20 is mounted a distance below the respective landing 4 greater than the maximum accepted level of misalignment so that the luminaire 20 remains below the level of the lift car floor 7 and the landing 4 when the lift car and landing doors 11/6 are open.

Figure 9A:
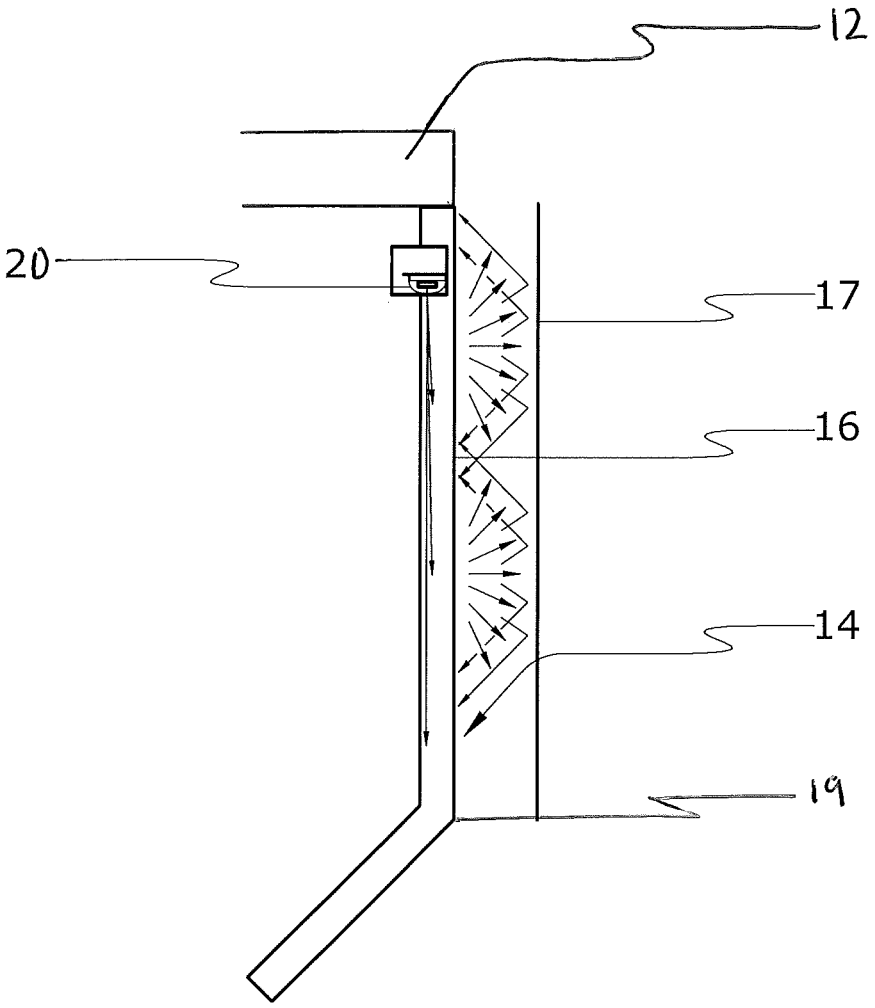
FIG. 9A is a partial detail view of a toe guard according to another embodiment of the present invention.
Figure 9B:
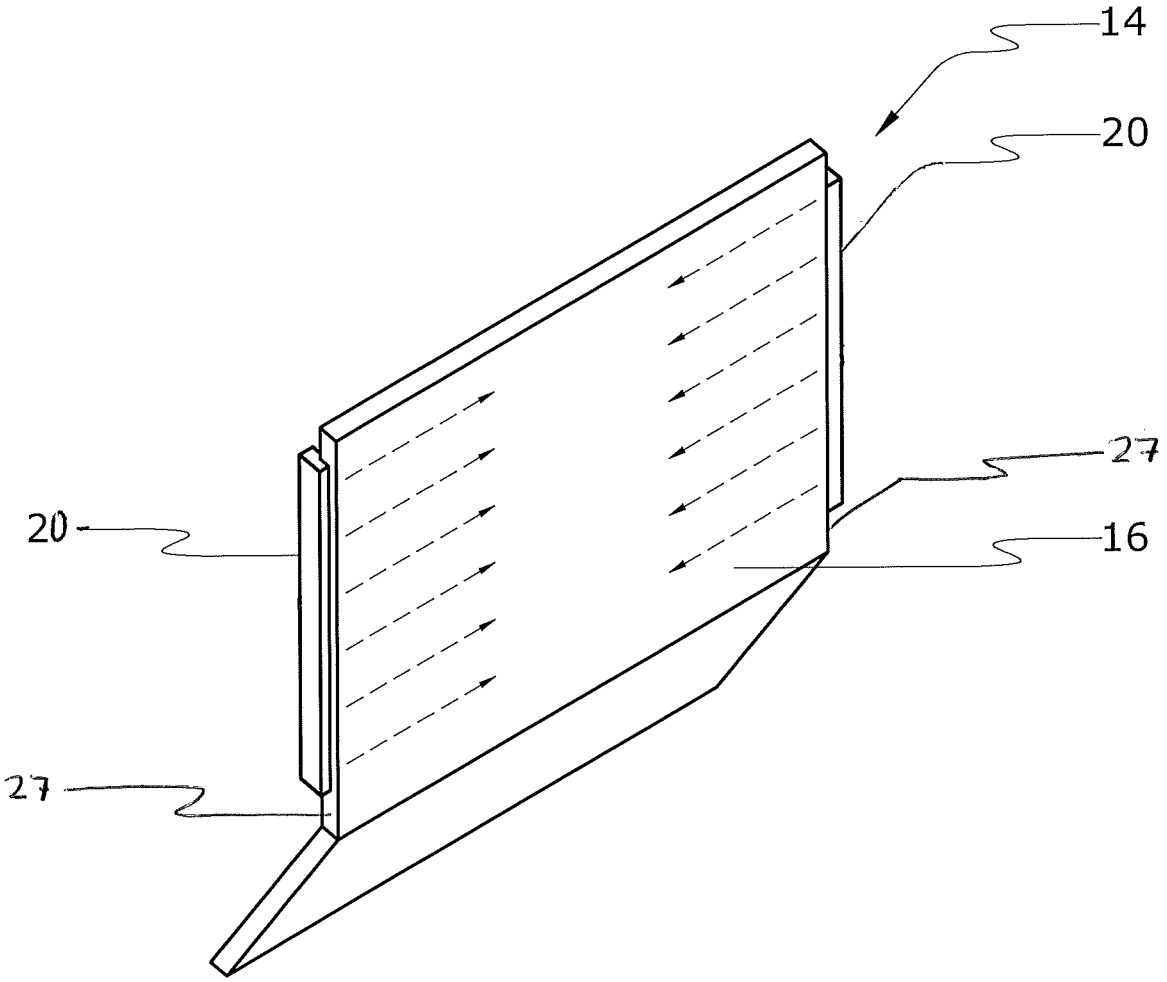
FIG. 9B is a partial detail view of a toe guard according to another embodiment of the present invention.
Figure 9C:
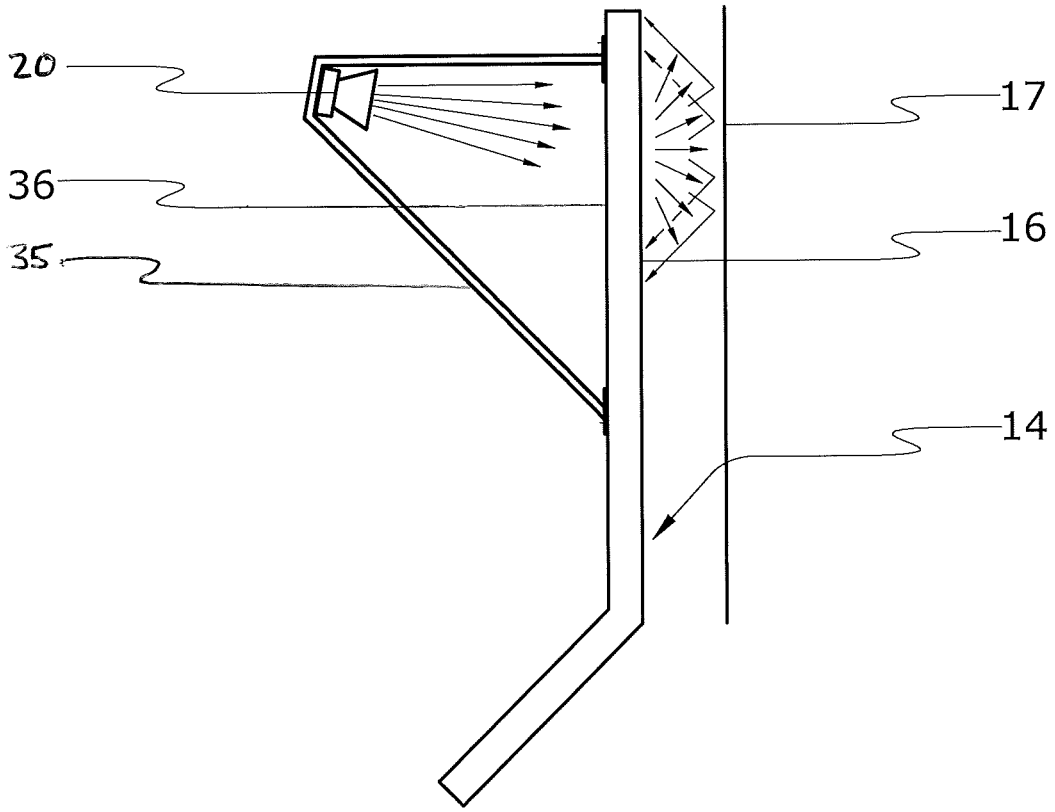
FIG. 9C is a partial detail view of a toe guard according to another embodiment of the present invention.

Further embodiments of the invention are shown by FIGS. 9A to 9C, in such embodiments the toe guard 14 is made of a translucent material with at least one luminaire 20 mounted to direct light into the translucent toe guard 14. This has the effect of diffusing the emitted light so that it is spread out and softened.

In the embodiment shown by FIG. 9A, one or more luminaires 20 are embedded into the translucent toe guard 14 adjacent the lift car sill 12 and arranged to direct light to diffuse through said toe guard 14 toward the lower edge 19 of the toe guard 14.

In the embodiment shown by FIG. 9B, luminaires 20 are mounted along the vertical edges 27 of the translucent toe guard 14 to direct light to diffuse through said toe guard 14 toward the respective opposing edge 27.

In the embodiment shown by FIG. 9C, one or more luminaires 20 are mounted to a back face 36 of the translucent toe guard 14. The luminaires 20 are attached to a mounting frame 35 which extends away from the back face 36 in order to support the luminaires 20 at a distance from the back face 36. By supporting the luminaires 20 at a distance from the back face 36, the spread of light incident on the back face 36 is increased so that light diffused through the toe guard 14 is more evenly emitted from the opposing planar face 16 of the toe guard 14.

It shall be appreciated that in the above embodiments, by diffusing light through a translucent toe guard 14, a substantial portion of the planar face 16 of the toe guard 14 becomes light emitting. Therefore, when the lift car floor 7 and the landing 4 are within the maximum accepted level of misalignment, the light emitting portion of the planar face 16 of the toe guard 14 will overlap the vertical wall 17 of the lift shaft 3 so that at least a portion of the light emitted by the one or more luminaires 20 is reflected off of the vertical wall 17. Thus, when the lift car floor 7 and the landing 4 are misaligned so that the lift car floor 7 is disposed below the landing 4, light reflected from the vertical wall 17 of the lift shaft 3 warns passengers exiting the lift car 2 of the trip hazard created by the misalignment. Similarly, when the lift car floor 7 and landing 4 are misaligned so that the lift car floor 7 is disposed above the landing 4, light reflected from the vertical wall 17 of the lift shaft 3 illuminates the sill 12 of the lift car 2 to warn passengers entering the lift car 2 of the trip hazard created by the misalignment. It shall be yet further appreciated that, when the lift car floor 7 is disposed above the landing 4 to the extent that the toe guard 14 is visible to passengers waiting on the landing 4, the diffuse light emitted from the toe guard 14 is sufficiently softened by the translucence of the toe guard 14 so that passengers looking at the running clearance 21 are not dazzled.

It shall be appreciated that in the embodiments shown by FIGS. 9A to 9C, the toe guard 14 may instead be transparent and the one or more luminaires 20 mounted a distance below the lift car sill 12 so that, when the lift car floor 7 and the landing 4 are within the maximum accepted level of misalignment, light is transmitted through the transparent toe guard 14 toward the vertical wall 17 of the lift shaft 3.

According to the invention, the luminaire 20 may be any appropriate lighting device, though preferably the luminaire 20 is an LED lighting device such as an LED strip light or an LED spot light. Advantageously, multiple coloured LEDs may be provided. It is envisaged that multiple coloured LEDs provide the option of changing the colour of light used to illuminate the running clearance 21 according to the floor level. Further, it is envisaged that the colour of the LED light may be set according to the lift operators preferences.

It is envisaged that the method may be carried out on existing lift car systems to retrofit them with the luminaire according to the invention.

What is claimed is:

1. A method of adapting an elevator system to warn elevator users of a vertical misalignment between a floor of a lift car and a landing surface adjacent to which said lift car stops, wherein a gap exists between a first wall depending vertically downwards from a leading edge of the floor of the lift car and a second wall depending vertically downwards from a leading edge of the landing surface, the first wall and second wall being parallel and opposing another, the method including positioning a luminaire on at least one of said first wall or said second wall so that the luminaire directs light toward the opposing one of the first wall or the second wall irrespective of a quantity of said vertical misalignment, so that at least a portion of the light emitted from said luminaire reflects off said opposing wall prior to passing out of said gap.

2. A method of adapting an elevator system according to claim 1, wherein the elevator system has a maximum accepted quantity of vertical misalignment at which the elevator system will remain operational and the method further comprises positioning the luminaire at a distance below the respective leading edge by a distance which is greater than said maximum accepted quantity of vertical misalignment.

3. A method of adapting an elevator system according to claim 1, wherein the first wall comprises a toe guard and the method further includes the step of positioning a luminaire on said toe guard.

4. A method of adapting an elevator system according to claim 3, wherein the toe guard comprises at least one opening, the method further comprising the step of positioning a luminaire in at least one opening so that it is flush with, or recessed below, a front surface of the toe guard.

5. A method of adapting an elevator system according to claim 4, wherein the toe guard comprises a plurality of openings provided across a width of the toe guard and the method further includes the step of mounting a luminaire in each of the openings of the plurality of openings to provide illumination across the width of the toe guard.

6. A method of adapting an elevator system according to claim 3, wherein the toe guard comprises a mounting surface extending from a front face of the toe guard, and the method further includes the step of mounting a luminaire onto the mounting surface to direct light across the front face of the toe guard.

7. A method of adapting an elevator system according to claim 6, wherein said mounting surface is perpendicular to the front face of the toe guard such that a luminaire positioned on said mounting surface directs light transversely across the front face of the toe guard.

8. A method of adapting an elevator system according to claim 1, comprising the additional steps of applying a translucent filter to the luminaire and directing light from said luminaire through the translucent filter to flood said gap with diffuse light.

9. A method of adapting an elevator system according to claim 1, wherein the first wall is a translucent toe guard, the method further including the step of positioning the luminaire to direct light into the translucent toe guard such that the translucent toe guard diffuses the light emitted by the luminaire to flood said gap with diffuse light.

10. An elevator system comprising a lift car, the elevator system being adapted to warn elevator users of a vertical misalignment between a floor of the lift car and a landing surface adjacent to which the lift car stops, wherein a gap exists between a first wall depending vertically downwards from a leading edge of the lift car floor and a second wall depending vertically downwards from a leading edge of the landing surface, the first wall and second wall being parallel and opposing another, the system including at least one luminaire on at least one of said first wall or said second wall, wherein the luminaire is configured to direct light toward the opposing one of the first wall or second wall irrespective of a quantity of said vertical misalignment so that at least a portion of the light emitted from said luminaire reflects off said opposing wall prior to passing out of said gap.

11. An elevator system according to claim 10, wherein there is a maximum accepted quantity of misalignment between the floor of the lift car and the landing surface at which the elevator system will remain operational, the luminaire being positioned at a distance below the respective leading edge by a distance which is greater than said maximum accepted quantity of vertical misalignment.

12. An elevator system according to claim 10, wherein the first wall comprises a toe guard.

13. An elevator system according to claim 12, wherein the toe guard comprises at least one opening, the luminaire being received in at least one opening so that a light emitting portion of the luminaire is flush with, or recessed below, a front face of the toe guard.

14. An elevator system according to claim 13, wherein the toe guard comprises a plurality of openings extending across a width of the toe guard, wherein a luminaire is received in each of the openings of the plurality of openings to provide illumination across the width of the toe guard.

15. A method of adapting an elevator system according to claim 1, wherein the luminaire is an LED strip light and the method further includes the step of mounting the LED strip light to one of the first wall or the second wall.

16. An elevator system according to claim 10, wherein the luminaire is an LED strip light.

17. An elevator system according to claim 12, wherein the toe guard comprises a mounting surface extending from a front face of the toe guard, and wherein the luminaire is mounted on the mounting surface to direct light across the front face of the toe guard.

18. An elevator system according to claim 17, wherein the mounting surface is perpendicular to the front face of the toe guard so that the luminaire directs light transversely across the front face of the toe guard.

19. An elevator system according to claim 10, wherein the luminaire comprises a translucent filter configured to diffuse light emitted by the luminaire to flood said gap with diffuse light.

20. An elevator system according to claim 10, wherein the first wall is a translucent toe guard, wherein the luminaire is configured to direct light into the translucent toe guard such that the translucent toe guard diffuses the light emitted by the luminaire to flood said gap with diffuse light.

* * * * *